United States Patent [19]

Morell et al.

[11] Patent Number: 5,063,693

[45] Date of Patent: Nov. 12, 1991

[54] ALPINE SKI BOOT HAVING A SUPPORTING FLEXION ELEMENT

[75] Inventors: Joseph Morell, Annecy; Louis Benoit, Frangy, both of France

[73] Assignee: Salomon S.A., Annecy Cedex, France

[21] Appl. No.: 870,532

[22] Filed: Jun. 4, 1986

[30] Foreign Application Priority Data

Jun. 12, 1985 [FR] France ..... 85 09179

[51] Int. Cl.[5] ..... A43B 5/04

[52] U.S. Cl. ..... 36/121; 36/120

[58] Field of Search ..... 36/117-121, 36/105

[56] References Cited

U.S. PATENT DOCUMENTS

| | | | |
|---|---|---|---|
| 3,619,914 | 11/1971 | Hanson et al. . | |
| 3,738,025 | 6/1973 | Hanson et al. . | |
| 3,832,792 | 9/1974 | Kastinger . | |
| 3,848,347 | 11/1974 | Hanson et al. . | |
| 3,988,842 | 11/1976 | Rathmell . | |
| 4,095,356 | 6/1978 | Robran et al. | 36/121 |
| 4,186,501 | 2/1980 | Salomon | 36/121 |
| 4,282,658 | 11/1981 | Hanson et al. | 36/121 |
| 4,317,297 | 3/1982 | Hanson | 36/121 |
| 4,381,613 | 5/1983 | Lederer | 36/121 |
| 4,455,768 | 6/1984 | Salomon | 36/121 |
| 4,577,420 | 3/1986 | Petrini et al. | 36/121 |
| 4,620,380 | 11/1986 | Aldino | 36/121 |
| 4,694,593 | 9/1987 | Petrini et al. | 36/120 |

FOREIGN PATENT DOCUMENTS

| | | | |
|---|---|---|---|
| 0329407 | 5/1976 | Austria . | |
| 0339772 | 11/1977 | Austria . | |
| 0172159 | 2/1986 | European Pat. Off. | 36/117 |
| 2037248 | 7/1970 | Fed. Rep. of Germany . | |
| 2410515 | 3/1974 | Fed. Rep. of Germany . | |
| 2404447 | 8/1974 | Fed. Rep. of Germany . | |
| 2730364 | 1/1978 | Fed. Rep. of Germany . | |
| 2096248 | 2/1972 | France . | |
| 2100490 | 3/1972 | France . | |
| 2103171 | 4/1972 | France . | |
| 2166677 | 8/1973 | France . | |
| 2184322 | 12/1973 | France . | |
| 2220201 | 10/1974 | France . | |
| 2256734 | 8/1975 | France . | |
| 2276851 | 1/1976 | France . | |
| 2278280 | 2/1976 | France . | |
| 2371162 | 6/1978 | France . | |
| 2416661 | 9/1979 | France . | |
| 2480575 | 10/1981 | France . | |
| 2495901 | 6/1982 | France . | |
| 2539278 | 7/1984 | France | 36/117 |
| 2484800 | 12/1984 | France . | |
| 2546726 | 12/1984 | France . | |
| 2555418 | 5/1985 | France . | |
| 2564710 | 11/1985 | France | 36/117 |

*Primary Examiner*—Jimmy G. Foster

*Attorney, Agent, or Firm*—Sandler, Greenblum & Bernstein

[57] ABSTRACT

A ski boot comprises a rigid shell base on which an upper is adapted to be journalled. The upper comprises a rear spoiler and a front cuff, and the lower edge of the cuff is adapted to cooperate with the upper surface of the shell base via a flexion element. The flexion element is mounted substantially transversely to the longitudinal axis of the boot, and is continuously in support with the lower edge of the cuff, or is formed integrally with the lower edge of the cuff. The support is provided substantially along the longitudinal axis of the boot, i.e., along a central portion of the lower edge of the cuff. The use of this type of flexion element makes it possible to ensure, for expert or skillful skiers, that the upper will flex perfectly about the axis of the boot.

3 Claims, 6 Drawing Sheets

1
5
7
4
8
6
10
3
15
9
16
2
9
15
14
10

1
5
7
4
8
6
B
10'
3
B
9
16
2

9
14

9
10
2

ALPINE SKI BOOT HAVING A SUPPORTING FLEXION ELEMENT

BACKGROUND OF THE INVENTION

1. Field of the Invention

The present invention relates generally to boots, and more specifically to ski boots which comprise a molded shell base adapted to surround the foot of a skier and by an upper which is similarly molded as one or more portions which are adapted to surround the lower leg of the skier; the upper is journalled on the shell base.

2. Description of Relevant Materials and Prior Art

Attempts have been made to provide conventional rigid boots with good flexional properties but leave them capable of transmitting forces and permitting skiers to control his skis. These types of constructions have been developed, e.g., in French Patent Application No. 2,276,851. In this French application a ski boot is illustrated in which flexion control is achieved by deforming and extending the lower edge of a portion of the upper which cooperates with the upper surface of a rigid shell base during forward flexional movements of the leg of a skier. Further, rear entry boot constructions are known having uppers which have, located at the bottom of their front zones, a type of slot which is positioned in transverse fashion to the longitudinal axis of the boot so as to define a lower border for the upper which serves as a deformation band which will extend or stretch during forward flexion of the leg of a skier. In such constructions, the band can be provided with a predetermined elasticity, dependent upon the nature of the material used to form the upper.

These types of ski boot constructions, in which entry of the foot of the skier is through the rear of the boot, and which include a rigid shell base without any opening on the front of the foot, provide good shock absorption characteristics for the upper; unfortunately, such constructions do not permit the necessary elastic return that a skier will expect from the boot.

Accordingly, attempts have been made to overcome such disadvantage by providing ski boots with an upper having progressively adjustable flexional characteristics; and at the same time ski boots which are capable of preventing extreme flexions which would exceed limits provided by the anatomy of the connection between the lower leg and the foot of a skier.

Thus, French Patent 2,480,575 discloses a boot having an apparatus for adjusting the flexional characteristics of a ski boot which apparatus is positioned at the lower periphery of the upper and which comprises a support surface provided on the upper which is capable of transmitting flexional forces of the leg to a flexion element which is adapted to cooperate with the shell base of the boot via at least one abutment which is slidably mounted within a guide. It is thus capable of modifying the conditions under which the forces are transmitted as a function of the positions occupied by each of said abutments while they are being guided.

The same type of construction is disclosed in French Patent 2,484,800, in which the flexion element is spaced from the lower edge of the upper so as to form a transverse slot. The slot is, in turn, interrupted by a supporting abutment which ensures direct contact between the lower edge of the upper and the flexion element during forward flexional movements of the boot.

In both of these cases, the abutments (which may or may not be slidable) are positioned along both sides of the mean longitudinal plane of the boot; alternately, a single abutment can be provided along one side of the plane of the boot. Such arrangements can lead to unbalanced flexions along either side of the mean longitudinal plane; while expert and other particularly demanding skiers require that the majority of flexion occur along the mean longitudinal plane of the boot.

Accordingly, the present invention attempts to overcome the disadvantages of the prior art by requiring the forces transmitted from the edge of the upper to the flexion element to occur along the longitudinal axis of the ski boot; and to be able to adjust the forces which are transmitted.

SUMMARY OF THE INVENTION

The present invention is provided for in a first aspect thereof by a ski boot comprising a rigid shell base and a cuff journalled thereto, said cuff having a lower edge which is adapted to cooperate with an upper surface of said shell base via at least one flexion element. The flexion element is mounted transversely to a longitudinal axis of said boot and is adapted to extend over at least a portion of the periphery of the foot of a skier using said boot over a zone extending along the flexion fold of the instep of the skier, wherein the flexion element is in continuous supporting contact with said lower cuff edge at least along the longitudinal axis of the boot. The flexion element can be integrally formed with said lower cuff edge, or the cuff and flexion element can be separate members, in which case the flexion element will be detachably connected to the shell base.

The flexion element has first and second ends attached to opposed portions of said shell base and is adapted to cooperate with a slidable cursor positioned between said shell base and said flexion element, which element comprises means for transmitting forces from said cuff to said shell base; the cursor serves to limit the effective active length of said flexion element. The flexion element can either comprise means for maintaining substantially linear contact with said lower edge of said boot cuff or for maintaining substantially punctual contact with said lower cuff edge. The flexion element has first and second free ends, each of said free ends either being adapted to be attached to said shell base along opposite sides of said boot, or to be positioned between the shell base and respective guidance edges positioned along both sides of said boot.

The flexion element can have a central slot located between an upper active arm which is adapted to abut said lower cuff edge and a lower arm which rests on said shell base, and at least one movable support cursor is slidably positioned within said slot.

At least one slidable support cursor can be slidably positioned between a lower edge of said flexion element and a shoulder on said shell base. The shoulder can either be formed integrally with said shell base, or the shoulder and shell base can be separate members, in which case the shoulder is adapted be attached to said shell base as a guide ring. The flexion element can be integrally formed with said cuff or separately attached.

The present invention is provided for in another aspect thereof by a ski boot comprising a rigid shell base and a cuff journalled to an upper surface of said shell base, said cuff having a lower edge, said ski boot further comprising at least one flexion element which is mounted on an upper surface of said shell base and which comprises means for continuously supporting the lower edge of said cuff at least at a point along the longitudinal axis of said ski boot. The flexion element can have an upper edge which is in continuous contact with said lower cuff edge, can be substantially arcuate, and has first and second ends which can be detachably connected to said shell base. The flexion element is also adapted to fit over the boot substantially along the instep of a skier.

In one embodiment, the flexion element comprises an upper flexion arm, a lower arm and a central slot, at least one slidable cursor being positioned within said slot and being adapted to be adjustably positioned between two free ends of said flexion element. The slot can have a central portion which is wider than the remainder of said slot, or the slot can have a substantially uniform width.

The flexion element can have an upper surface which is either in continuous point or line contact with said lower cuff edge; and the element can have first and second free ends and is attached to said shell base by fastening means located only at said two ends.

Alternately, the flexion element is substantially solid, i.e., planar, and has a first end and a second end attached to said shell base, said substantially planar flexion element having an upper surface which is in substantially continuous line contact with said lower cuff edge. Further, a substantially arcuate guide ring is attached to said upper surface of said shell base in spaced relation from a lower edge of said flexion element, wherein both said flexion element and said guide ring have unattached portions which are spaced upwardly from said upper surface of said shell base.

At least one slidable cursor can be provided having two flanges which are, respectively, inserted between said shell base upper surface and a lower surface of said flexion element, and between said shell base upper surface and a lower surface of said guide ring. The guide ring can be integrally molded with, or attached to, said shell base.

The flexion element can either have a substantially constant width between its two ends, or it can alternately have a central portion of greater width than the remainder of said flexion element.

The flexion element, in one embodiment, can have an offset central portion which comprises means for providing a substantially continuous point contact between said flexion element and said lower cuff edge.

In another embodiment, the flexion element is integrally connected to said lower cuff edge. The flexion element can have first and second ends, an upper flexion arm, and a lower arm, said arms being separated by an elongated slot, said flexion element further comprising a slidable cursor which is slidable from said first slot end to said second slot end.

The shell base can include a shoulder area having two ends and a central portion, said central portion and said two ends of said shoulder area being spaced upwardly from said upper surface of said shell base, wherein said first and second free ends of said flexion element and a portion of said lower arm are positioned within the space between the shoulder and the shell base.

Alternately, the flexion element can comprise a substantially planar bar having first and second free ends, said shell base having two guide slots located on opposed sides of said boot, wherein said first and second ends of said flexion element are positioned within guide slots on said opposite boot sides.

At least one substantially arcuate guide ring can be attached to said upper surface of said shell base, said guide ring having a lower surface spaced upwardly from said upper surface of said shell base, wherein a cursor is slidably positioned within the spaces formed between said lower surface of said guidance ring and said upper surface of said shell base and the lower surface of said flexion element and the upper surface of said shell base, respectively. The shell base and the guidance ring may be integrally molded to each other, or they can be attached by a plurality of fastening elements to said shell base.

The present invention is provided for in yet another aspect by a flexion element which is adapted to be attached to the shell base of a ski boot and which has an upper surface which is adapted to continuously contact a lower edge of a cuff which is pivotally attached to said ski boot, said flexion element comprising first and second free ends, an upper arm, and a lower arm, said upper and lower arms being integrally attached to each other at said first and second ends, said upper and lower arms being separated by an elongated slot. A cursor is slidably positioned within said slot and adapted to move from said first end of said flexion element to said second end of said flexion element. The slot may have a uniform width over its entire extent, or the slot may have a central portion with a width which is greater than the width of the remaining portions of said slot.

In another aspect thereof, the present invention comprises a flexion element adapted to be positioned on the upper surface of a ski boot shell base, said flexion element comprising a substantially arcuate bar having first and second free ends and substantially parallel sides, said first and second ends being adapted to be attached to opposed sides of said shell base, a central portion of said flexion element being offset from the remaining portions of said flexion element to provide a surface which is adapted to support the lower edge of a cuff along at least the longitudinal axis of a ski boot to which said ski boot is journalled, when said flexion element is attached at said first and second ends to said shell base.

In another aspect, the present invention comprises a cuff adapted to be journalled to the upper surface of a ski boot, said cuff comprising a curved body portion which fits around the leg of a skier when the cuff is journalled to said ski boot, said cuff further comprising a flexion element having first and second free ends which are adapted to be attached to the upper surface of said shell base, said flexion element and said curved body portion of said cuff being attached by a central narrow neck portion. The flexion element comprises a substantially planar bar which is spaced from a lower edge of the remainder of said cuff portion by a space having a width equal to the width of said neck. Alternately, the flexion element comprises an upper arm spaced from a lower edge of the body portion of said cuff by a distance approximately equal to the width of said neck, a lower arm attached at said first and second ends of said flexion element to said upper arm, and a slot separating said lower and upper arms from each other.

BRIEF DESCRIPTION OF THE DRAWINGS

The above and other objects, features and advantages of the present invention will be more fully described herein with respect to the accompanying drawings, in which like reference numerals represent similar parts throughout, and wherein.

DESCRIPTION OF PREFERRED EMBODIMENTS

Figure 1:
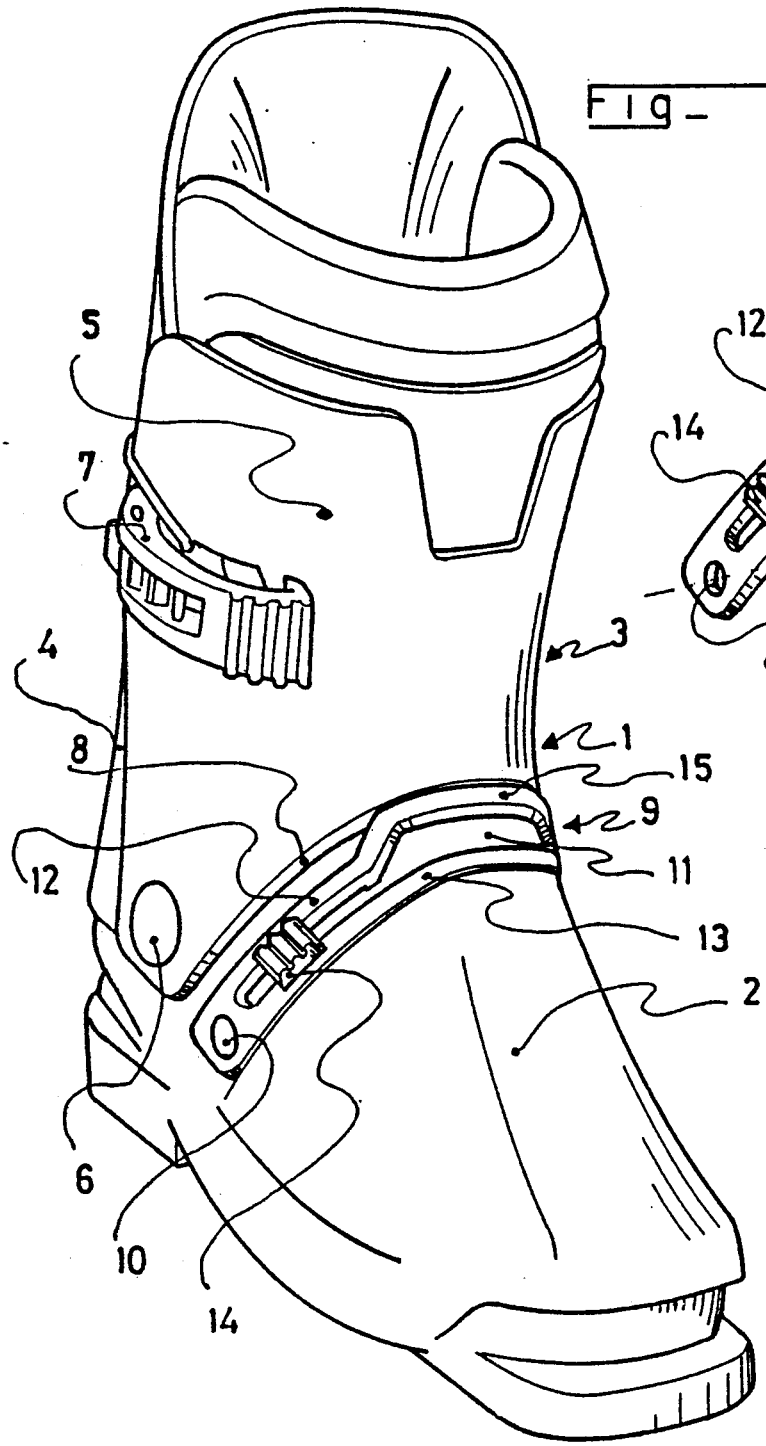
FIG. 1 is a side perspective view of a ski boot formed in accordance with a first embodiment of the present invention.

With more specific reference to the attached drawings, FIGS. 1, 3–5, 7 and 9 all illustrate a ski boot 1 comprising, in a conventional fashion, a rigid shell base 2 formed from rigid plastic material on which an upper 3 is journalled, the upper being adapted to surround the lower leg of a skier. The upper comprises a rear portion or spoiler 4 and a front portion or cuff 5. As illustrated, rear spoiler 4 and cuff 5 are simultaneously journalled to the shell base along a single axis 6, the axis being positioned substantially along the zone of the malleolli of the skier. Such an arrangement assures rear entry of the foot of a skier into the boot. A closure device in the form of a buckle 7 is provided along an upper portion of the upper and permits tightening of upper 3 about the lower leg of a skier. Cuff 5 terminates towards the bottom of shell 2 at a lower edge 8. The lower edge is located above the flexion fold of a skier extends towards the rear of the boot, and surrounds the top of the foot of the skier until its ends reach points adjacent an area about axis 6. Cuff edge 8 cooperates with the upper surface of the shell base 2 via a flexion element 9 which is mounted transversely with respect to the longitudinal axis of the boot. The mounting is achieved by surrounding or enclosing at least one portion of the top of the foot of the skier along a zone which extends along the flexion fold of the instep of a skier.

In all of the embodiments of FIGS. 1–6, flexion element 9, which extends between cuff 5 and shell base 2, is attached at its free ends to the shell base. The attachment points for the free ends are located just forwardly of journal axis 6 by linkage means 10, e.g., rivets, staples, elastic attachments or fittings, or welding, e.g., ultrasound welding. The means for connecting the free ends to the shell base are preferably disassemblable in order to permit flexion elements 9 to be easily detached from the shell base and/or interchanged.

Figure 7A:
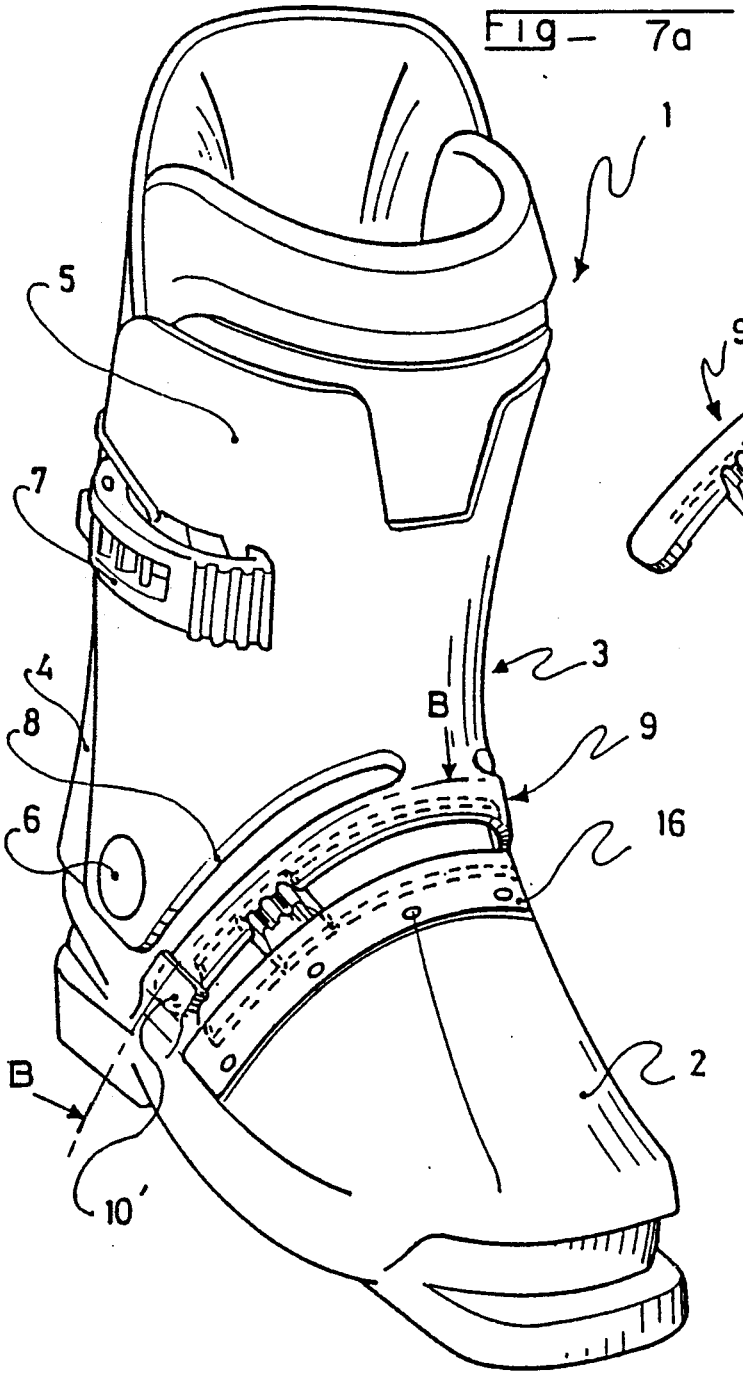
FIGS. 7*a* and 7*b* are perspective views of a fifth embodiment of a ski boot formed in accordance with the present invention.
Figure 7B:
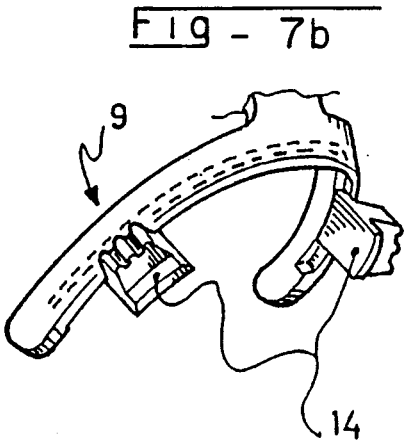
Figure 8:
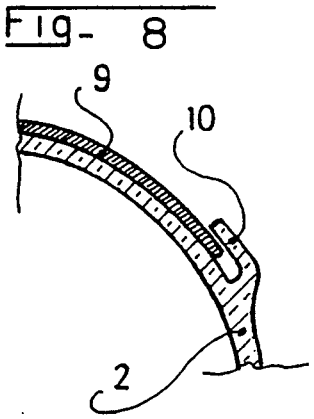
FIG. 8 is a partial cross-sectional view taken along line B—B of FIG. 7.
Figure 9:
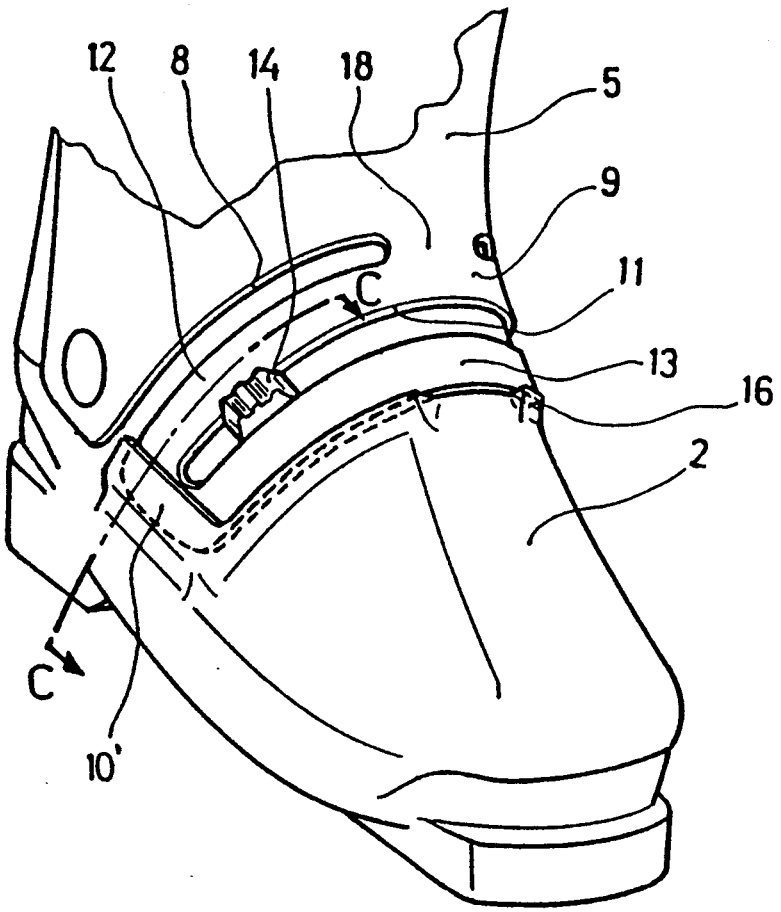
FIG. 9 is a partial perspective view of a sixth embodiment of a ski boot formed in accordance with the present invention.

In the embodiments of FIGS. 7 and 9, flexion element 9 is formed integrally with cuff 5 and can be attached at its ends to shell base 2; to the contrary, as illustrated in FIG. 8, the ends of the flexion element can remain free under maintenance and guidance edge 10'.

Figure 2:
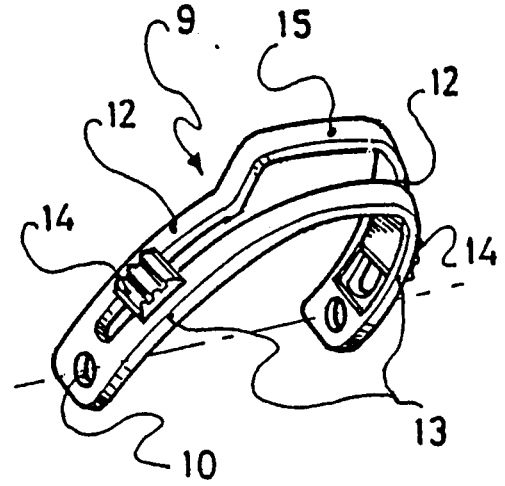
FIG. 2 is a perspective view of the flexion element used in the ski boot of FIG. 1.
Figure 3A:
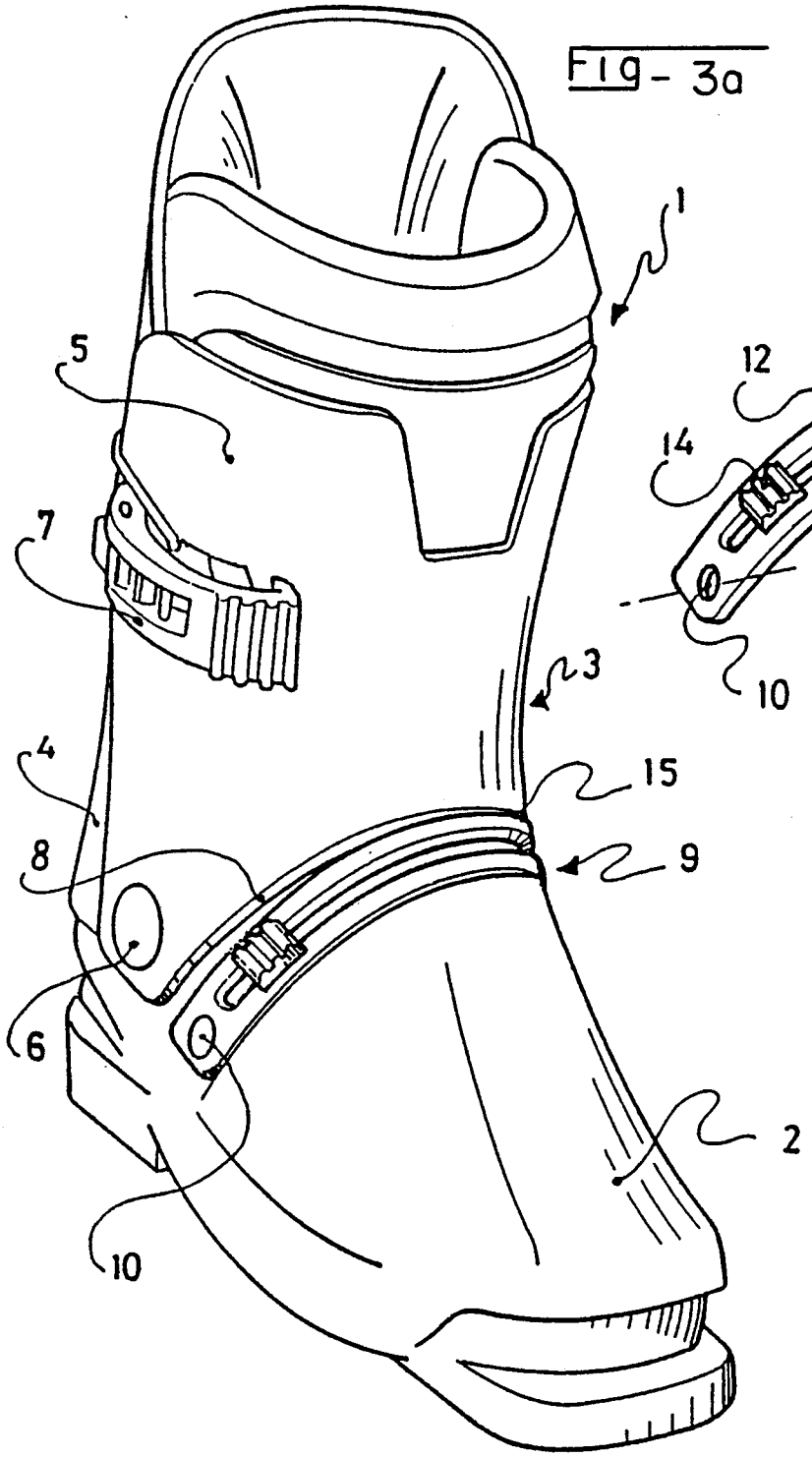
FIGS. 3*a* and 3*b* are perspective views of a second embodiment of a ski boot formed in accordance with the present invention.
Figure 3B:
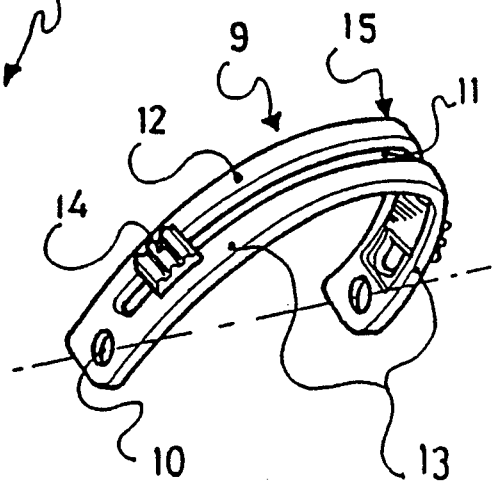

In the embodiments illustrated in FIGS. 1–3, flexion element 9 includes a slot 11 which divides the flexion element into two substantially parallel, distinct arms about the periphery of the foot of a skier. More specifically, flexion element 9 is divided into an upper arm 12 upon which cuff 5 rests when the flexion element is attached to the boot and a lower arm 13, which rests either on a shoulder of shell base 2; or, for shell bases without shoulders, has a trajectory of motion which engages the upper surface of shell base 2 when the lower arm is displaced towards the front of the boot. Two abutments or cursors 14 are provided which can slide in slot 11 on both sides of the boot. The abutments or cursors 14 can be maneuvered along slot 11 when a skier is in a normal static position in the boot. Cursors 14 and slot 11 can be of the type in French Patent 2,480,575, which has been discussed above; and they are provided to adjust the amount of flexional force transmitted.

According to an essential characteristic of the present invention, flexion element 9 cooperates with lower edge 8 of cuff 5 along the level of the longitudinal axis of the boot, i.e., at a substantially central portion of the cuff and flexion element. In the embodiment illustrated in FIGS. 1 and 2, upper arm 12, i.e., the active flexion portion of flexion element 9, creates a zone adjacent the midpoint of the flexion element which is configured so as to assure, together with edge 8, a substantially linear abutment support 15. In the embodiment in FIG. 3, on the other hand, upper active arm 12 itself assures a substantially punctual abutment support 15 for a central point of cuff edge 8.

Figures 4A, 4B:
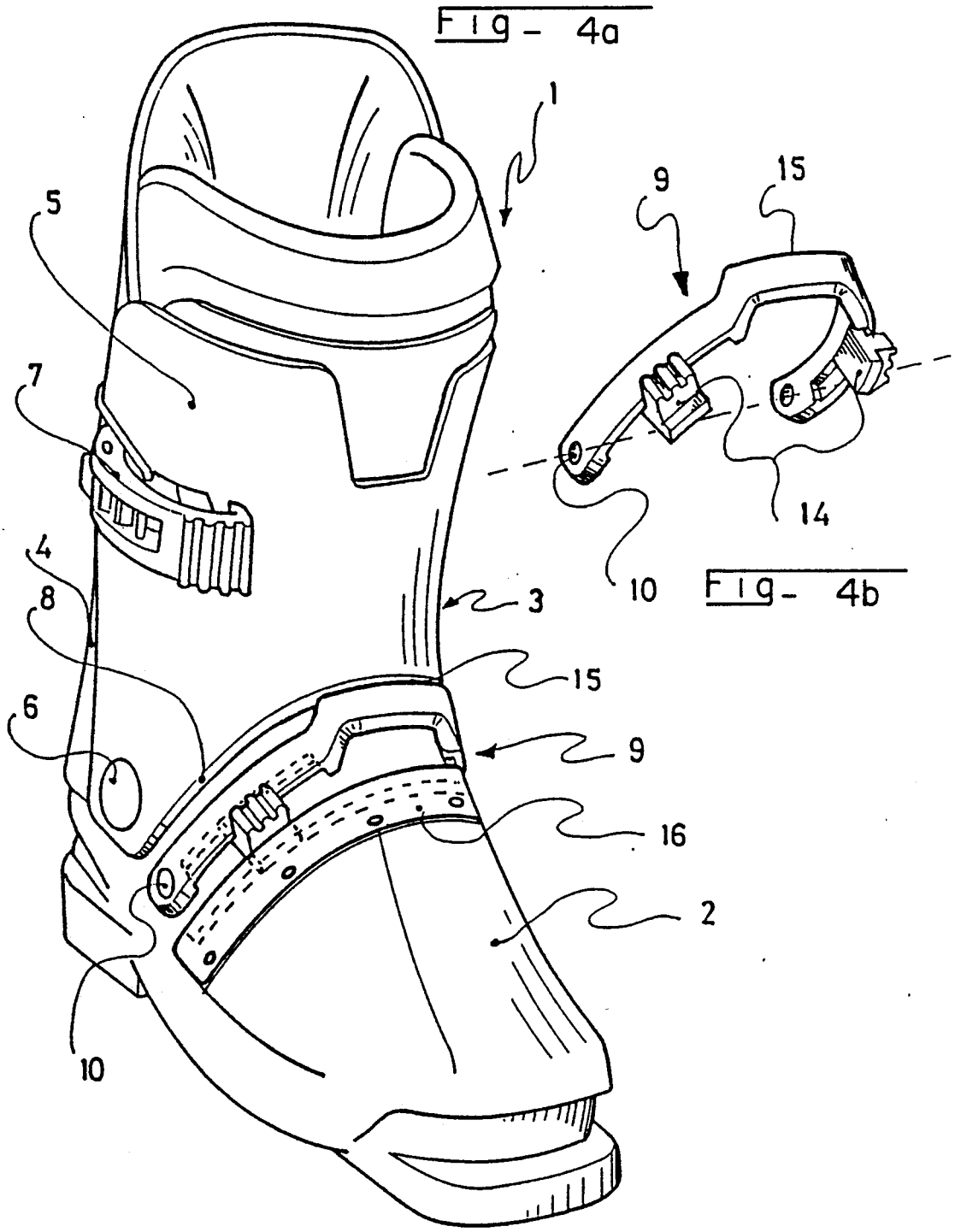
FIGS. 4*a* and 4*b* are side perspective views of a third embodiment of a ski boot formed in accordance with the present invention.

According to the embodiment of the invention which is illustrated in FIG. 4, support element 9 does not include a slot, but instead comprises a substantially planar, uninterrupted element or bar; there is, therefore, no reason to distinguish between an arm which actively assists in flexion and a passive arm in this embodiment. Flexion element 9 serves in the embodiment of FIG. 4 in a fashion similar to the active upper arm of the preceeding embodiments (in FIGS. 1 and 3) and is adapted to cooperate with lower edge 8 of cuff 5 along the level of the longitudinal axis of the boot in a substantially linear supporting fashion, as illustrated in FIG. 4. Shell base 2 includes a shoulder or guidance ring 16 which is attached to the shell base by fasteners at its ends or which is molded integrally therewith; the shoulder is located approximately parallel to flexion element 9, and at least one cursor 14 is positioned between flexion element 9 and shoulder 16 so as to form a displaceable abutment as in the other embodiments of the invention. In this case, the lower flanges of each cursor (unreferenced) will be slidably positioned between the upper surface of the shell base and the respective lower surfaces of the flexion element and the guidance ring.

Figure 5A:
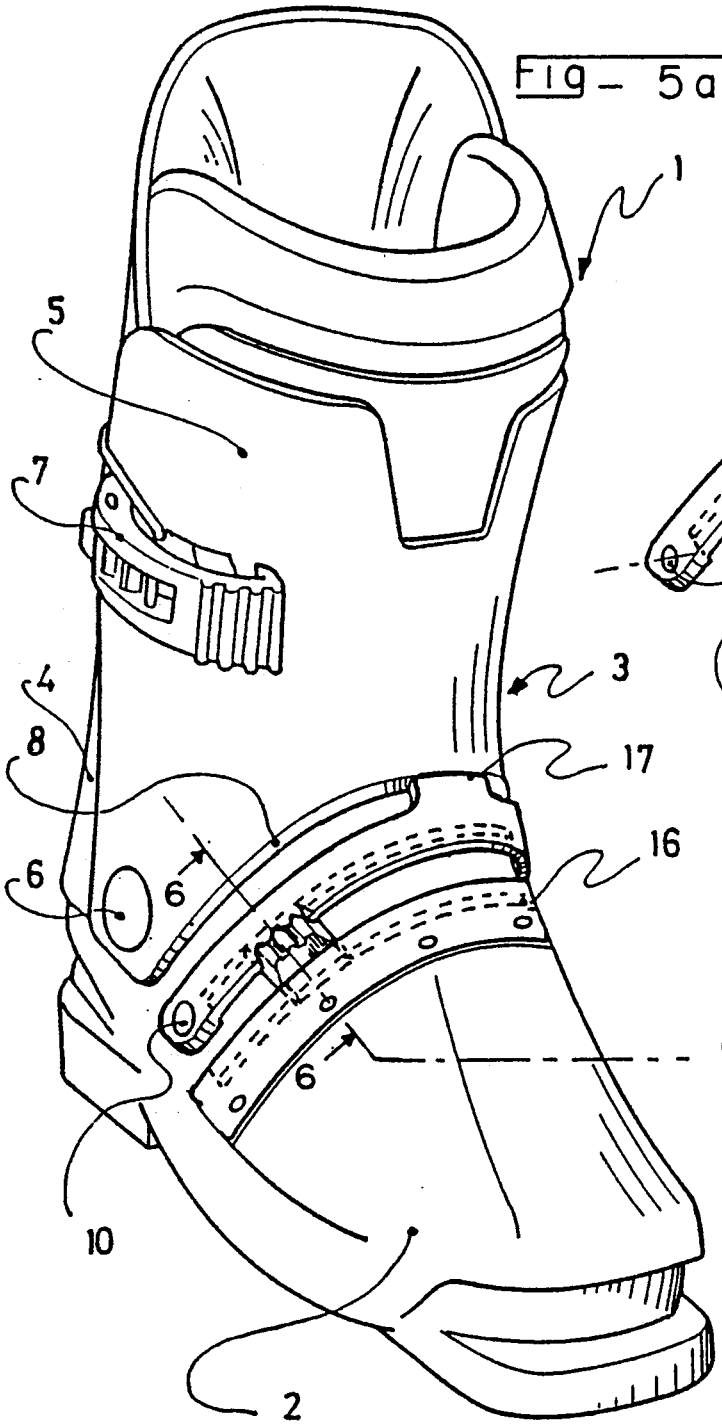
FIGS. 5*a* and 5*b* are perspective views of a fourth embodiment of a ski boot formed in accordance with the present invention.
Figure 5B:
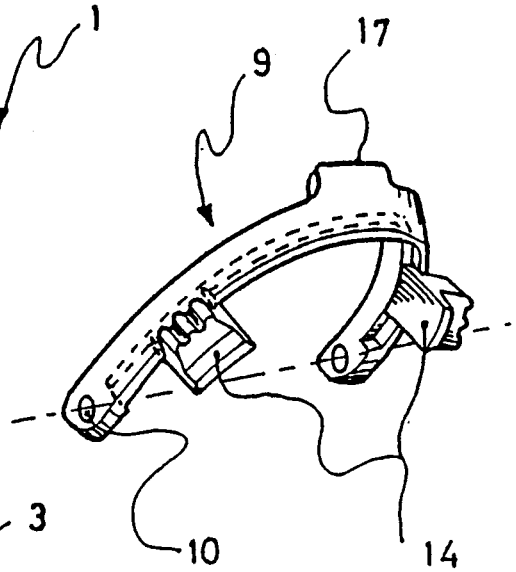
Figure 6:
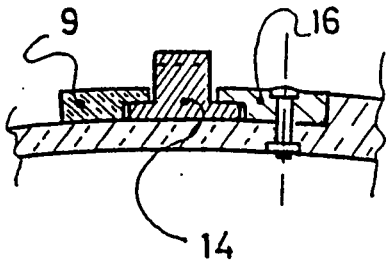
FIG. 6 is a partial sectional view taken along line A—A of FIG. 5.

In the embodiment illustrated in FIGS. 5 and 6, the characteristics referred to above are again present to provide a substantially point-type support between flexion element projection 17 and cuff lower edge 8, as illustrated best in FIG. 5. The projection is again located substantially at the level of the longitudinal axis of the boot, and approximately at the midpoint of the cuff and flexion element. FIG. 6 illustrates, in partial cross-section, a view taken along line A—A of FIG. 5 so as to illustrate one possible arrangement for flexion element 9, cursor 14, and guidance ring 16, which is attached at its two free ends to shell base 2 by conventional fasteners (unreferenced).

FIG. 7 illustrates yet another embodiment of the present invention in which flexion element 9 is integrally formed with cuff 5. Apart from this difference, substantially the same constructional characteristics as defined above with respect to the other embodiments of the invention are still provided. In this case, however, the free ends of flexional element 9 need not be positively secured to the remainder of the boot, but can instead be guided by a maintenance edge 10' which is either integrally formed with shell base 2 or which can be attached thereto by conventional fasteners; one such maintenance edge 10' is best illustrated in FIG. 8. In this case, the ends of the flexion element are retained within the guide edges 10'.

Figure 10:
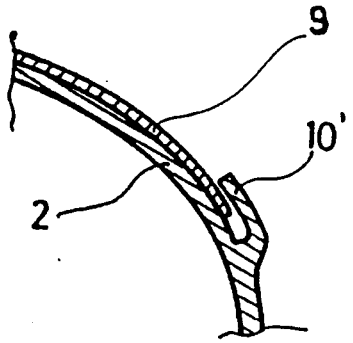
FIG. 10 is a cross-sectional view taken along line C—C of FIG. 9 illustrating the manner in which the flexion element is retained within a guide on the boot.

In the embodiment of FIGS. 9 and 10, the flexion element is again integrally formed with cuff 5, and includes a slot 11 similar to the slots of the embodiments of the invention illustrated in FIGS. 1-3. The slot extends at least partially along the periphery of the folding flexion zone of the instep of a skier along a direction which is substantially transverse to the longitudinal axis of the boot. In this embodiment, lower arm 13 rests against shoulder or abutment 16 of shell base 2, while upper arm 12 is integrally connected to cuff 5 by a relatively narrow neck portion or extension 18. In this embodiment, upper arm 12 is formed integrally with cuff 5 and is connected to the main portion of the cuff by an extension 18 of lower cuff edge 8. This extension is preferably positioned along both sides of the longitudinal median planar zone of the boot. The ends of flexion element 9 are again left free under a maintenance and guiding edge 10', as best illustrated in FIG. 10 (and as in the embodiment of FIGS. 7 and 8). Adjustment of the flexional force is again achieved by two movable abutments or cursors 14 which are adapted to be displaced along slot 11. It is clearly within the scope of the present invention to alternately use only a single cursor 14 which is displaceable along the periphery of the flexion fold zone. As in the embodiments of the ski boots of FIGS. 1-3, the cursor has lower flanges which are slidably engaged between the upper surface of shell base 2 and the lower surfaces of arms 11 and 13, respectively.

In all of the embodiments, the upper edge of the flexion element is in continuous supporting contact (either point or linear) with the lower edge of the cuff at least along the longitudinal axis of the boot; this occurs as a result of either the integral attachment of the cuff and flexion element (see FIGS. 7-10) or the positioning of separate cuff and flexion members (as in FIGS. 1-6).

In all of the various embodiments described and illustrated above, it would be obvious to one of ordinary skill in the art that a certain number of constructional features could be combined in different manners; and such detailed structures do not require additional description herein. Further, although the present invention has been described with respect to particular means, materials and embodiments, it is to be understood that it would be within the scope of one of ordinary skill in the art that the invention is not limited to the particular features and embodiments disclosed, and that it extends to all equivalents within the scope of the claims.

What is claimed is:

1. A ski boot comprising a rigid shell base and a cuff journalled to an upper surface of said shell base, said cuff having a lower edge, said ski boot further comprising at least one flexion element which is mounted on an upper surface of said shell base and which comprises means for continuously supporting said lower edge of said cuff at least at a point along the longitudinal axis of said ski boot, wherein said at least one flexion element has first and second ends, each of said ends being adapted to be attached to said shell base along opposite sides of said boot, wherein said flexion element comprises an upper flexion arm, a lower arm and a central slot, at least one slidable cursor being positioned within said slot and being adapted to be adjustably positioned between said first and second ends of said flexion element, and wherein said slot has a central portion which is wider than the remainder of said slot.

2. A ski boot formed in accordance with claim 1 wherein said flexion element has an upper surface which is in substantially continuous line contact with said lower cuff edge.

3. A flexion element which is adapted to be attached to the shell base of a ski boot and which has an upper surface which is adapted to continuously contact a lower edge of a cuff which is pivotally attached to said ski boot, said flexion element comprising first and second ends, an upper arm, and a lower arm, said upper and lower arm being integrally attached to each other at said first and said ends, said upper and lower arms being separated by an elongated slot, said flexion element being attached to said shell base at said first and second ends, wherein said slot has a central portion with a width which is greater than the width of the remaining portions of said slot.

* * * * *